US008083094B2

(12) United States Patent
Caulfield et al.

(10) Patent No.: US 8,083,094 B2
(45) Date of Patent: Dec. 27, 2011

(54) CONTAINER AND CAP ASSEMBLY

(75) Inventors: Peter Caulfield, Ontario (CA); Jeffrey H. Steiger, Auburn, AL (US); Randall Lecroy, Opelika, AL (US)

(73) Assignee: Capitol Vial Inc., Auburn, AL (US)

( * ) Notice: Subject to any disclaimer, the term of this patent is extended or adjusted under 35 U.S.C. 154(b) by 789 days.

(21) Appl. No.: 11/463,721

(22) Filed: Aug. 10, 2006

(65) Prior Publication Data

US 2008/0035658 A1 Feb. 14, 2008

(51) Int. Cl.
*B65D 43/06* (2006.01)

(52) U.S. Cl. ..... 220/783; 220/780

(58) Field of Classification Search ..... 220/780, 220/793, 795, 839, 4.23, 789, 783, 792; 215/351, 215/344, DIG. 1
See application file for complete search history.

(56) References Cited

U.S. PATENT DOCUMENTS

| | | | | |
|---|---|---|---|---|
| 2,828,789 | A | 4/1958 | Groendyk et al. | |
| 3,108,710 | A | 10/1963 | Lange et al. | |
| 3,428,208 | A | 2/1969 | Kosar | |
| 3,572,413 | A | 3/1971 | Livingstone | |
| 3,833,141 | A | 9/1974 | Leitz | |
| 3,881,627 | A | 5/1975 | Davolt | |
| 4,014,456 | A | 3/1977 | Echtle | |
| 4,334,631 | A | 6/1982 | Ballester | |
| 4,378,895 | A | 4/1983 | Woinarski | |
| 4,397,404 | A * | 8/1983 | Blanchette | 220/783 |
| 4,418,833 | A * | 12/1983 | Landis | 220/792 |
| 4,442,947 | A * | 4/1984 | Banich, Sr. | 215/344 |
| 4,444,332 | A | 4/1984 | Widen et al. | |
| 4,449,641 | A | 5/1984 | Jorgensen et al. | |
| 4,491,238 | A * | 1/1985 | Tobolt | 220/783 |
| 4,524,882 | A | 6/1985 | Buc | |
| 4,667,843 | A | 5/1987 | Galer | |
| 4,783,056 | A | 11/1988 | Abrams | |
| 4,787,530 | A * | 11/1988 | Edwards | 220/266 |
| 4,812,116 | A | 3/1989 | Abrams | |
| 5,133,470 | A | 7/1992 | Abrams et al. | |
| 5,165,562 | A | 11/1992 | Raney | |
| 5,312,011 | A * | 5/1994 | Fischer | 220/528 |
| 5,667,094 | A | 9/1997 | Rapchak et al. | |
| 5,723,085 | A | 3/1998 | Abrams et al. | |
| 5,964,372 | A | 10/1999 | Dubois et al. | |
| 6,202,904 | B1 * | 3/2001 | Casciano | 222/567 |
| 6,303,064 | B1 | 10/2001 | Abrams et al. | |
| RE37,676 | E | 4/2002 | Abrams et al. | |
| 6,401,957 | B1 | 6/2002 | Przytulla | |
| 6,491,185 | B1 | 12/2002 | Azzarello et al. | |
| 6,588,618 | B1 * | 7/2003 | Davis | 220/254.7 |
| 2002/0162846 | A1 | 11/2002 | Mercier | |
| 2004/0112906 | A1 * | 6/2004 | von Holdt, Jr. | 220/657 |

* cited by examiner

*Primary Examiner* — Anthony Stashick
*Assistant Examiner* — Jeffrey Allen
(74) *Attorney, Agent, or Firm* — Wood, Herron & Evans, LLP

(57) ABSTRACT

A container and cap assembly includes a container body and a cap integrally connected to the container body. An annular recess is formed in the lip of the container. The cap includes first and second sealing flanges that form a generally fluid tight seal with an annular lip of the container body.

26 Claims, 5 Drawing Sheets

CONTAINER AND CAP ASSEMBLY

FIELD OF THE INVENTION

This invention relates generally to containers and, more particularly, to a container having an integral cap for sealing an open end of the container.

BACKGROUND OF THE INVENTION

In the past, sealable containers, such as vials, have been used to collect, store and/or dispense liquids, such as a test sample of milk, urine, saliva or blood by way of example. The liquid sample may be collected in the vial at one site and then the vial is transported to another site where the liquid sample is removed from the vial and subjected to diagnostic testing.

Vials of the type to which the present invention relates are generally injection molded plastic vials that have caps adapted to seal the vial closed with a substantially fluid-tight seal. The cap may or may not be integrally connected to the vial, but oftentimes it is connected thereto by a flexible strap or tab.

Examples of several vials of this type and processes for making such vials are disclosed in U.S. Pat. Nos. 4,783,056, 4,812,116, 6,303,064 and RE 37,676 (a reissue of U.S. Pat. No. 5,723,085), all owned by the common assignee and each disclosure of which is hereby incorporated herein by reference in its entirety. Vials made according to these disclosed processes have the advantage of providing a reliable fluid-tight seal between the vial and the cap and may be made "sterile-by-process" wherein the heat from the molding process is used to maintain sterility while the cap is closed in the mold.

Other types of vials for collecting and transporting liquid samples include vials having a screw-on cap, such as disclosed in Davolt, U.S. Pat. No. 3,881,627. In the vial of Davolt, the vial is provided with screw threads on the outer portion of its neck. A V-shaped recess is provided in the lip of the vial and an upwardly facing, inclined, annular shoulder is provided on an inner wall of the neck. The cap has a cylindrical outer skirt and a shorter, inwardly spaced, inner cylindrical skirt adapted to be sealingly received against the annular shoulder provided on the inner wall of the neck to make sealing abutment therewith. An annular bead is provided on the cap between outer and inner skirts to seat against the V-shaped recess provided in the lip of the vial. The sealing approach of Davolt relies on plastic deformation of the inner skirt and the annular bead with their respective mating annular shoulder and V-shaped recess to provide a fluid-tight seal. One significant drawback of such a sealing approach is that the integrity of the various sealing engagements is compromised after the first use of the vial due to the plastic deformation of the parts. Consequently, such a vial may not provide a reliable fluid-tight seal to maintain the liquid sample within the vial following repeated openings and closings of the vial.

Accordingly, there is a need for an improved container having a cap for sealing the container that provides a reliable fluid-tight seal to contain a liquid sample within the container.

SUMMARY OF THE INVENTION

The present invention overcomes the foregoing and other shortcomings and drawbacks of containers heretofore known having a cap for sealing an open end of the container. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a container and cap assembly is provided having a container body, such as a vial, and a cap configured to seal the container body in a generally fluid-type manner.

In one embodiment, the container body has a closed end, an open end and an annular lip provided at the open end. An annular recess is formed in the lip of the container and defines an annular inner lip and an annular outer lip at the open end. A cap is integrally connected to the container body and has a top wall and an annular skirt wall depending from the top wall. An annular first sealing flange depends from the top wall of the cap and is disposed radially inwardly from the skirt wall of the cap. The first sealing flange is configured to be received within the recess formed in the lip of the container when the cap is closed over the open end and generally form a seal with the inner lip. An annular second sealing flange depends from the top wall of the cap and is disposed radially inwardly from the first sealing flange. The second sealing flange is configured to be received within the container body adjacent the inner lip and generally form a seal with an inner surface of the inner lip when the cap is closed over the open end.

The container and cap assembly of the present invention is intended to provide leak-proof characteristics at higher levels of internal pressure so that liquid samples contained within the container and cap assembly may be transported by air.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 3:
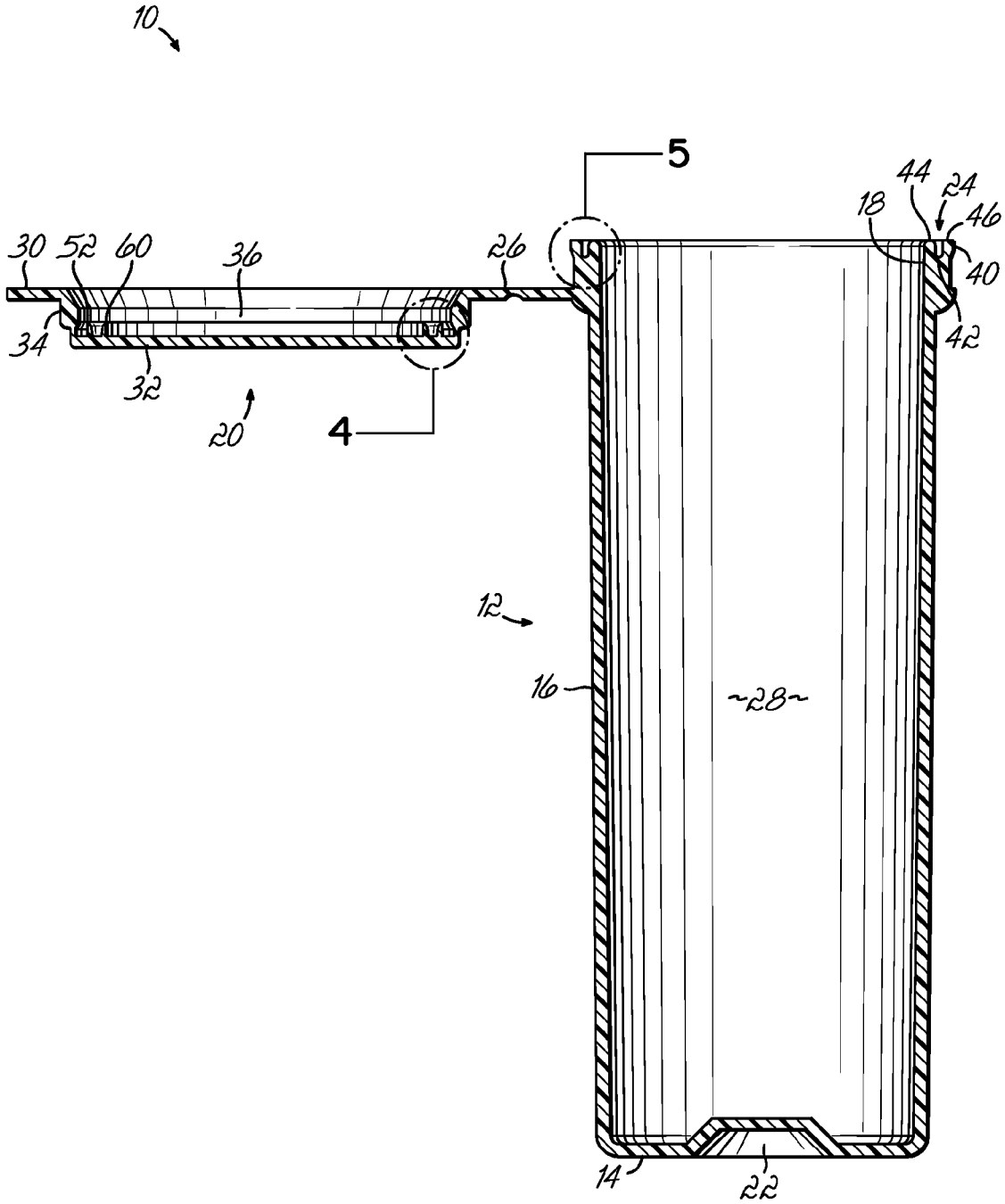
FIG. 3 is a cross-sectional view taken along line 3-3 of FIG. 2.

Referring now to the figures, a container and cap assembly 10 is shown in accordance with one embodiment of the present invention for collecting, storing, dispensing and/or transporting a liquid, such as a test sample of milk, urine, saliva or blood by way of example. The assembly 10 includes a container body 12, such as a vial, having a closed end 14, a generally tubular side wall 16 extending from the closed end 14 to an open end 18, and a cap 20 configured to close over the open end 18 to seal the container body 12 in a generally fluid-tight manner. The closed end 14 of the container body 12 may include a recessed central area 22 as shown in FIG. 3. As will be described in greater detail below, the cap 20 is configured to form a generally fluid-tight seal with an annular lip 24 provided at the open end 18 of the container body 12 when the cap 20 is closed over the open end 18.

Figure 1:
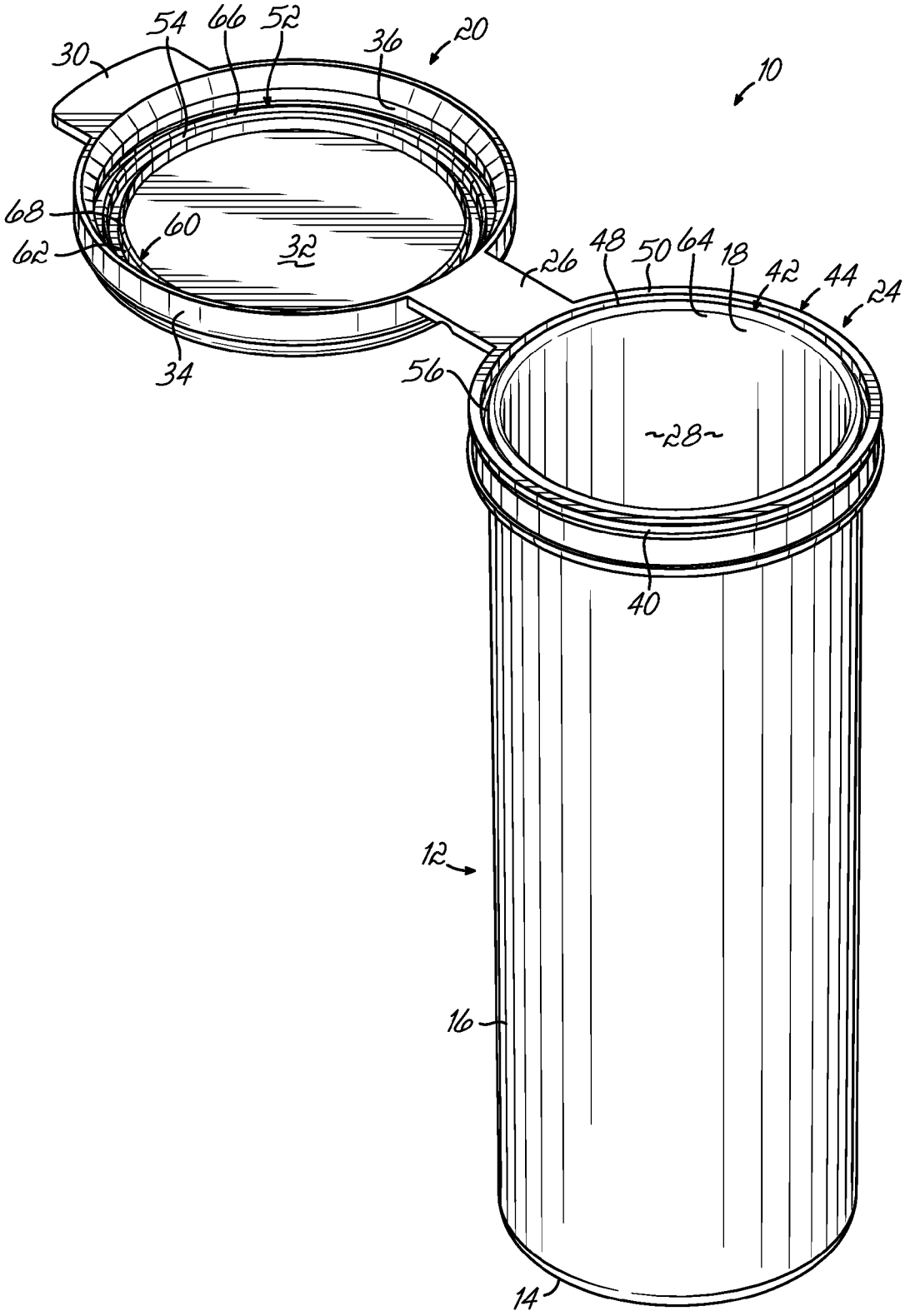
FIG. 1 is perspective view of a container and cap assembly according to one embodiment of the present invention, showing the cap removed from the open top of the container.
Figure 2:
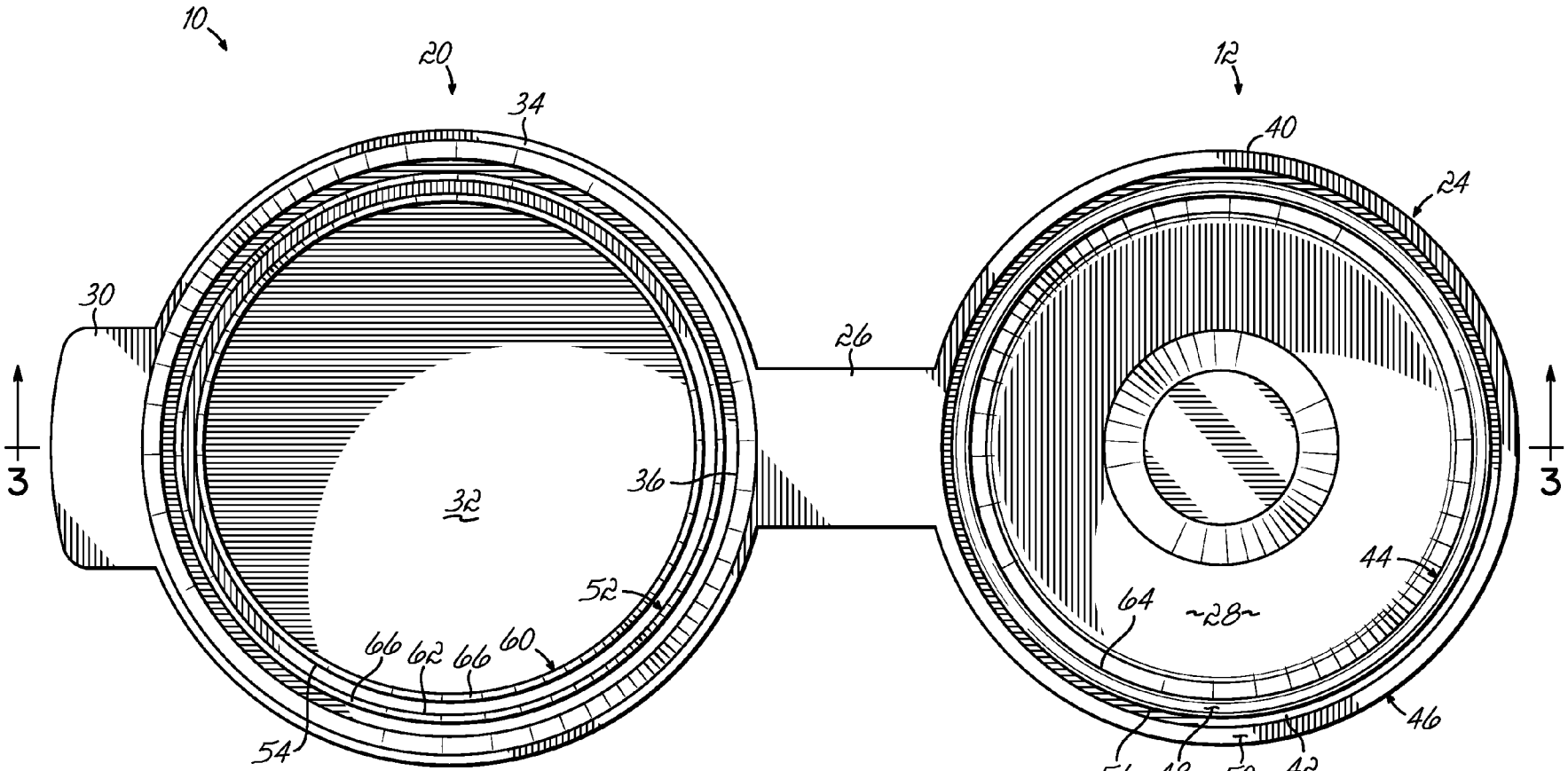
FIG. 2 is top plan view of the container and cap assembly shown in FIG. 1.
Figure 7:
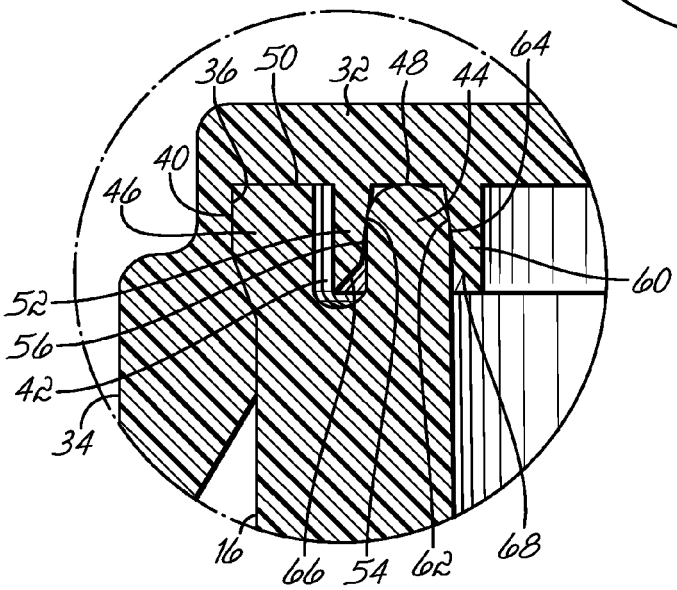
FIG. 7 is an enlarged view of the encircled area 7 shown in FIG. 6.
Figure 6:
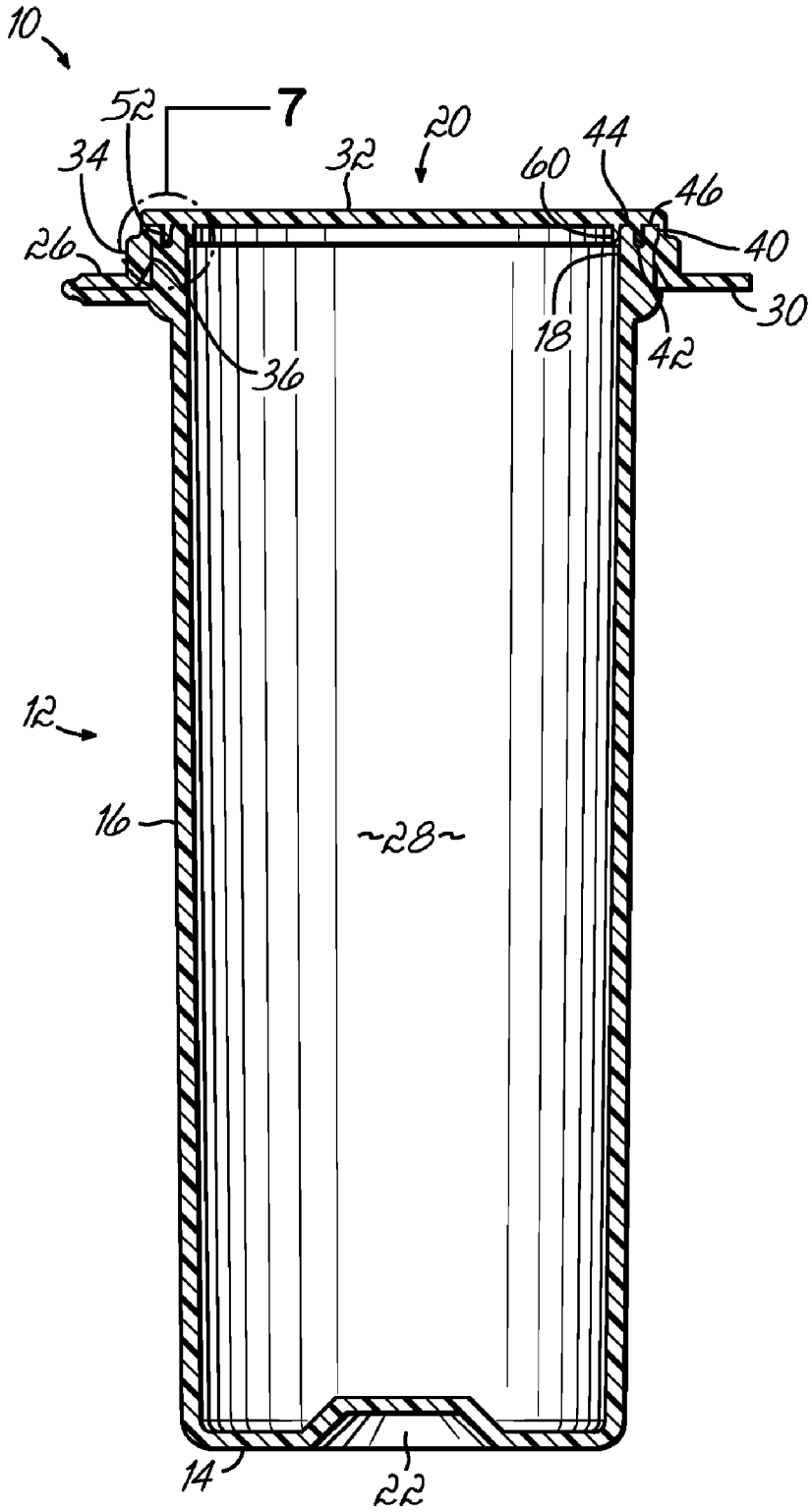
FIG. 6 is a cross-sectional view of the container and cap assembly of FIG. 1, showing the cap closed over the open top of the container.

In one embodiment, the assembly 10 may be made of a one-piece injection molded thermoplastic construction with the cap 20 formed integrally with the container body 12 during a molding operation and connected thereto by a flexible strap or tab 26. The strap or tab 26 allows the cap 20 to move between an open position as shown in FIGS. 1-3, wherein a cavity 28 within the container body 12 is accessible through the open end 18, and a closed position as shown in FIGS. 6 and 7, wherein the cap 20 forms a generally fluid-tight seal with the annular lip 24. A tab 30 (FIGS. 1-3 and 6) may be provided extending outwardly from the cap 20 to facilitate opening and closing of the cap 20 by hand during use of the container and cap assembly 10. The container and cap assembly 10 may be made of polypropylene, polyethylene, polystyrene or any other suitable material.

In one embodiment, the cap 20 includes a top wall 32 and a skirt wall 34 depending from the top wall 32. An inner surface 36 of the skirt wall 34 is provided with a contour (see FIG. 7) that is configured to generally form a seal with a contoured outer surface 40 provided on the annular lip 24 when the cap 20 is closed as shown in FIGS. 6 and 7.

Figure 5:
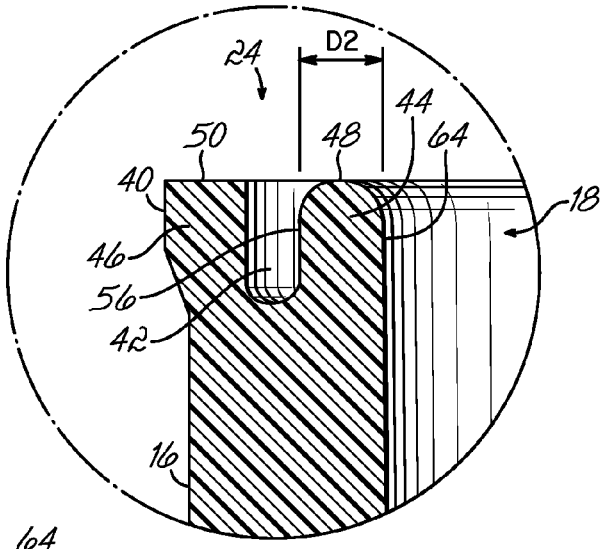
FIG. 5 is an enlarged view of the encircled portion 5 shown in FIG. 3.

In accordance with one aspect of the present invention, an annular recess 42 (FIGS. 1 and 5) is provided in the annular lip 24 to define an annular inner lip 44 and an annular outer lip 46. The inner lip 44 is spaced from the outer lip 46 by the recess 42. The inner lip 44 may include an upper surface 48 having a radiused cross-sectional profile while the outer lip 46 may include an upper surface 50 having a generally planar cross-sectional profile as shown in FIG. 5. In one embodiment, the cap 20 generally forms a seal with the upper surfaces 48 and 50 of the inner and outer lips 44 and 46, respectively, when the cap 20 is closed. It should be understood that other configurations and cross-sectional profiles of the inner and outer lips 44 and 46 are possible as well.

In accordance with another aspect of the present invention, the cap 20 includes a first annular sealing flange 52 that depends from the top wall 32 and is located radially inwardly from the skirt wall 34. The first sealing flange 52 is configured to be received in the recess 42 when the cap 20 is closed and has an inner surface 54 that generally forms a seal with an outer surface 56 of the inner lip 44. An annular gap 58 (FIG. 4) is formed between the first sealing flange 52 and the skirt wall 34 that is configured to receive the outer lip 44 of the container body 12 therein when the cap 20 is closed as shown in FIGS. 6 and 7.

The cap 20 also includes a second annular sealing flange 60 that depends from the top wall 32 and is located radially inwardly from the first sealing flange 52. The second sealing flange 60 is configured to be received within the container body 12 adjacent the inner lip 44. When the cap 20 is closed as shown in FIG. 7, the second sealing flange 60 has an outer surface 62 that generally forms a seal with an inner surface 64 of the inner lip 44.

Figure 4:
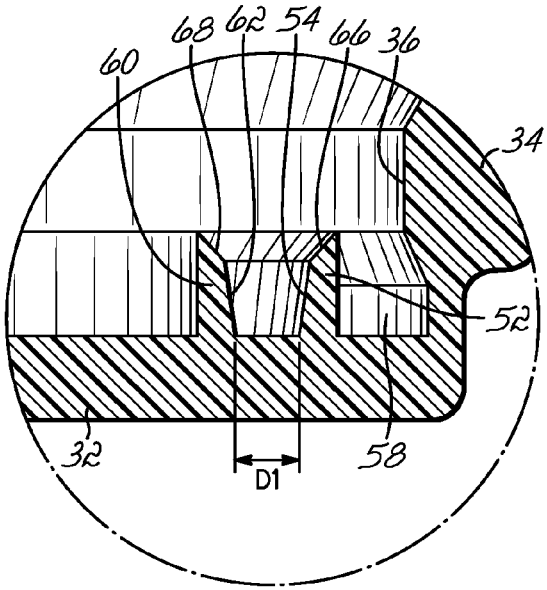
FIG. 4 is an enlarged view of the encircled portion 4 shown in FIG. 3.

As shown in FIGS. 4 and 7, the inner surface 54 of the first sealing flange 52 confronts the outer surface 62 of the second sealing flange 60 (FIGS. 4 and 7). Proximate the junctures of the first and second sealing flanges 52 and 60 with the cap 20, the confronting surfaces 54 and 62 of the sealing flanges 52 and 60, respectively, may be spaced apart a distance "D1" (FIG. 4) that is slightly less than a cross-sectional thickness "D2" (FIG. 5) of inner lip 44. The first and second sealing flanges 52 and 60 may be generally flexible so that as the inner lip 44 is received between the first and second sealing flanges 52 and 60 as the cap 20 is closed, the first and second sealing flanges 52 and 60 deflect away from each other as shown in FIG. 7. In this way, multiple sealing engagements are provided between the cap 20 and the annular lip 24 when the cap 20 is closed. These multiple sealing engagements include: 1) the outer surface 62 of the second sealing flange 60 and the inner surface 64 of the inner lip 44, 2) the upper surface 48 of the inner lip 44 and the cap 20, 3) the inner surface 54 of the first sealing flange 52 and the outer surface 56 of the inner lip 44, 4) the upper surface 50 of the outer lip 46 and the cap 20, and 5) the inner surface 36 of the skirt wall 34 and the outer surface 40 of the annular lip 24.

In one embodiment, as shown in FIGS. 4 and 7, each of the first and second sealing flanges 52 and 60 is provided at its free end with a chamfered surface 66 and 68, respectively. Each of the chamfered surfaces 66 and 68 confronts the inner lip 44 and cooperates with the radiused upper surface 48 of the inner lip 44 to facilitate closing of the cap 20 over the open end 18 when the inner lip 44 is received between the first and second sealing flanges 52 and 60. The first and second sealing flanges 52 and 60 may have generally the same height, although it will be appreciated that other configurations of the first and second sealing flanges 52 and 60 are possible as well.

The container and cap assembly 10 may be molded according to the processes fully disclosed in U.S. Pat. Nos. 4,783,056, 4,812,116, 6,303,064 and RE 37,676 (a reissue of U.S. Pat. No. 5,723,085), all owned by the common assignee and each disclosure of which is hereby incorporated herein by reference in its entirety. For example, in one embodiment, the container body 12 and the integral cap 20 may be injection molded of molten plastic material and the cap 20 may be closed over the open end 18 of the container body 12 before the molten plastic material has fully set. In this way, the cap 20 and container body 12 are allowed to cure and shrink together over a period of time while the cap 20 is closed so that the "fit" of the multiple engagement surfaces providing the various seals occurs after molding while the cap 20 and container body 18 cure and shrink together. The cap 20 may be closed while the container and cap assembly 10 is still in the mold. The heat from the molding process may be used to maintain sterility as the cap is closed so that the container and cap assembly 10 is "sterile-by-process."

The container and cap assembly 10 of the present invention is intended to provide leak-proof characteristics at higher levels of internal pressure so that liquid samples contained within the container and cap assembly 10 may be transported by air.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of Applicants' general inventive concept.

Having described the invention, we claim:

1. A container and cap assembly, comprising:

a container body defining a cavity and having a closed end, an open end and an annular lip at the open end;

a single annular recess formed in the lip of the container, the recess defining an annular inner lip and an annular outer lip at the open end;

a cap integrally connected to the container body and having a top wall and an annular skirt wall depending from the top wall;

an annular first sealing flange depending from the top wall of the cap and being disposed radially inwardly from the skirt wall of the cap, the first sealing flange being configured to be received within the recess formed in the lip of the container when the cap is closed over the open end; and an annular second sealing flange depending from the top wall of the cap and being disposed radially inwardly from the first sealing flange, the second sealing flange being configured to be received within the cavity defined by the container body adjacent the inner lip and generally form a seal with an inner surface of the inner lip when the cap is closed over the open end, wherein the first and second sealing flanges are generally flexible so as to deflected away from each other when the cap is closed, with the first sealing flange received within the recess and having an outer surface of the first sealing flange spaced laterally from an inner surface of the outer lip by a gap at a juncture of the first sealing flange with the top wall of the cap, and further wherein the cap is configured to generally form a seal with an upper surface of the outer lip when the cap is closed over the open end.

2. The assembly of claim 1, wherein the inner lip includes an upper surface having a radiused cross-sectional profile.

3. The assembly of claim 2, wherein the outer lip includes an upper surface having a generally planar cross-sectional profile.

4. The assembly of claim 1, wherein the first sealing flange has a chamfered surface provided at a free end thereof.

5. The assembly of claim 1, wherein the second sealing flange has a chamfered surface provided at a free end thereof.

6. The assembly of claim 4, wherein the chamfered surface of the first sealing flange faces the inner lip when the cap is closed over the open end.

7. The assembly of claim 5, wherein the chamfered surface of the second sealing flange faces the inner lip when the cap is closed over the open end.

8. The assembly of claim 1, wherein proximate junctures of the first and second sealing flanges with the cap, the first and second sealing flanges have confronting surfaces that are spaced apart a distance that is less than a cross-sectional thickness of the inner lip.

9. The assembly of claim 1, further comprising a flexible strap connecting the cap to the container body.

10. The assembly of claim 1, wherein the cap is configured to generally form a seal with an upper surface of the inner lip when the cap is closed over the open end.

11. The assembly of claim 1, wherein the first sealing flange is configured to generally form a seal with an outer surface of the inner lip when the cap is closed over the open end.

12. The assembly of 1, wherein the skirt wall of the cap is configured to generally form a seal with an outer surface of the outer lip when the cap is closed over the open end.

13. The assembly of claim 1, wherein the first and second sealing flanges have generally the same height.

14. The assembly of claim 1, further comprising a tab extending outwardly from the skirt wall of the cap.

15. A container and cap assembly, comprising:

a container body defining a cavity and having a closed end, an open end and an annular lip at the open end;

a single annular recess formed in the lip of the container, the recess defining an annular inner lip and an annular outer lip at the open end;

a cap integrally connected to the container body and having a top wall and an annular skirt wall depending from the top wall;

an annular first sealing flange depending from the top wall of the cap and being disposed radially inwardly from the skirt wall of the cap, the first sealing flange being configured to be received within the recess formed in the lip of the container when the cap is closed over the open end; and an annular second sealing flange depending from the top wall of the cap and being disposed radially inwardly from the first sealing flange, the second sealing flange being configured to be received within the cavity defined by the container body adjacent the inner lip and generally form a seal with an inner surface of the inner lip when the cap is closed over the open end, wherein the first and second sealing flanges are generally flexible so as to deflected away from each other when the cap is closed, with the first sealing flange received within the recess and having an outer surface of the first sealing flange spaced laterally from an inner surface of the outer lip by a gap at a juncture of the first sealing flange with the top wall of the cap, and further wherein the skirt wall of the cap is configured to generally form a seal with an outer surface of the outer lip when the cap is closed over the open end.

16. The assembly of claim 15, wherein the inner lip includes an upper surface having a radiused cross-sectional profile.

17. The assembly of claim 16, wherein the outer lip includes an upper surface having a generally planar cross-sectional profile.

18. The assembly of claim 15, wherein the first sealing flange has a chamfered surface provided at a free end thereof.

19. The assembly of claim 15, wherein the second sealing flange has a chamfered surface provided at a free end thereof.

20. The assembly of claim 18, wherein the chamfered surface of the first sealing flange faces the inner lip when the cap is closed over the open end.

21. The assembly of claim 19, wherein the chamfered surface of the second sealing flange faces the inner lip when the cap is closed over the open end.

22. The assembly of claim 15, further comprising a flexible strap connecting the cap to the container body.

23. The assembly of claim 15, wherein the cap is configured to generally form a seal with an upper surface of the inner lip when the cap is closed over the open end.

24. The assembly of claim 15, wherein the first sealing flange is configured to generally form a seal with an outer surface of the inner lip when the cap is closed over the open end.

25. The assembly of claim 15, wherein the first and second sealing flanges have generally the same height.

26. The assembly of claim 15, further comprising a tab extending outwardly from the skirt wall of the cap.

* * * * *

UNITED STATES PATENT AND TRADEMARK OFFICE

CERTIFICATE OF CORRECTION

PATENT NO. : 8,083,094 B2
APPLICATION NO. : 11/463721
DATED : December 27, 2011
INVENTOR(S) : Peter Caulfield It is certified that error appears in the above-identified patent and that said Letters Patent is hereby corrected as shown below:

In column 2, line 41, change "FIG. 1 is perspective view" to --FIG. 1 is a perspective view--.

In column 2, line 44, change "FIG. 2 is top plan view" to --FIG. 2 is a top plan view--.

In column 5, line 21, claim 1, change "so as to deflected away" to --so as to be deflected away--, as shown in Applicants' After Final Amendment filed on July 26, 2010, at Page 2, claim 1, last paragraph.

In column 5, line 59, claim 12, change "The assembly of 1," to --The assembly of claim 1,--.

In column 6, line 26, claim 15, change "so as to deflected away" to --so as to be deflected away--, as shown in Applicants' Amendment filed on October 20, 2011, at Page 8, claim 41, now claim 15, last paragraph.

Signed and Sealed this
Twenty-eighth Day of February, 2012

David J. Kappos

David J. Kappos
*Director of the United States Patent and Trademark Office*